US009685296B1

(12) United States Patent
Hoff et al.

(10) Patent No.: US 9,685,296 B1
(45) Date of Patent: Jun. 20, 2017

(54) NONLINEAR TRANSMISSION LINE BASED ELECTRON BEAM DENSITY MODULATOR

(71) Applicants: Brad Winston Hoff, Albuquerque, NM (US); David Michael French, Albuquerque, NM (US); Donald A. Shiffler, Albuquerque, NM (US); Susan L. Heidger, Albuquerque, NM (US); Wilkin W. Tang, Albuquerque, NM (US)

(72) Inventors: Brad Winston Hoff, Albuquerque, NM (US); David Michael French, Albuquerque, NM (US); Donald A. Shiffler, Albuquerque, NM (US); Susan L. Heidger, Albuquerque, NM (US); Wilkin W. Tang, Albuquerque, NM (US)

(73) Assignee: THE UNITED STATES OF AMERICA AS REPRESENTED BY THE SECRETARY OF THE AIR FORCE, Washington, DC (US)

( * ) Notice: Subject to any disclaimer, the term of this patent is extended or adjusted under 35 U.S.C. 154(b) by 158 days.

(21) Appl. No.: 14/316,766

(22) Filed: Jun. 26, 2014

Related U.S. Application Data

(62) Division of application No. 13/245,250, filed on Sep. 26, 2011, now Pat. No. 8,766,541.

(51) Int. Cl.
*H01J 7/24* (2006.01)
*H01J 29/52* (2006.01)

(52) U.S. Cl.
CPC ..... *H01J 29/52* (2013.01); *H01J 2229/70* (2013.01)

(58) Field of Classification Search
None
See application file for complete search history.

(56) References Cited

U.S. PATENT DOCUMENTS 2,798,981 A * 7/1957 Bryant ..... H01J 25/38 313/11
2,955,223 A * 10/1960 Kompfner ..... H01J 23/27 315/3.5
3,676,762 A * 7/1972 Saralidze ..... H01L 25/03 363/126
4,335,297 A * 6/1982 Little ..... B23K 15/00 219/121.21
4,422,013 A * 12/1983 Turchi ..... H01J 27/02 313/359.1
4,438,394 A * 3/1984 Ekdahl ..... G01R 15/16 324/126

(Continued)

OTHER PUBLICATIONS

Sanders et al "Pulse Sharpening and Solition Generation with NLTL for producing RF burst" 2010 p. 604-607.*

(Continued)

*Primary Examiner* — Douglas W Owens
*Assistant Examiner* — Srinivas Sathiraju
(74) *Attorney, Agent, or Firm* — James M. Skorich

(57) ABSTRACT

An apparatus for modulating the density of an electron beam as it is emitted from a cathode, comprised of connecting a source of pulsed input power to the input end of a nonlinear transmission line and connecting the output end directly to the cathode of an electron beam diode by a direct electrical connection.

10 Claims, 7 Drawing Sheets

(56) References Cited

U.S. PATENT DOCUMENTS 4,651,058 A * 3/1987 Hamada ..... H01J 31/124 313/422
4,780,647 A * 10/1988 Friedman ..... H05H 9/00 315/5
4,901,028 A * 2/1990 Gray ..... H01J 3/022 330/54
5,105,097 A * 4/1992 Rothe ..... H03K 17/80 307/108
5,232,902 A * 8/1993 Takemura ..... H01J 25/04 315/39
5,256,996 A * 10/1993 Marsland ..... H03H 7/325 257/275
5,378,939 A * 1/1995 Marsland ..... H03H 7/325 257/E27.012
5,977,715 A * 11/1999 Li ..... H05B 41/28 219/121.36
5,977,911 A * 11/1999 Green ..... H01Q 3/22 342/157
6,136,388 A * 10/2000 Raoux ..... C23C 16/345 427/569
6,291,940 B1 * 9/2001 Scholte Van Mast H01J 37/045 250/492.23
6,495,002 B1 * 12/2002 Klepper ..... C23C 14/0635 204/192.38
6,593,579 B2 * 7/2003 Whithman ..... H01J 3/02 250/423 F
6,686,680 B2 * 2/2004 Shaw ..... H01J 3/022 313/309
6,690,247 B2 * 2/2004 Kintis ..... H03K 5/156 307/106
6,980,142 B2 * 12/2005 Faris ..... H03M 1/32 250/492.2
7,298,091 B2 * 11/2007 Pickard ..... H03H 7/38 156/345.28
7,462,956 B2 * 12/2008 Lan ..... H03B 25/00 307/106
7,532,083 B2 * 5/2009 Hannah ..... H01P 3/08 333/20
7,612,629 B2 * 11/2009 Pepper ..... H03B 19/05 327/106
7,844,241 B2 * 11/2010 Kintis ..... H03D 7/1408 455/214
7,905,982 B2 * 3/2011 Howald ..... H01J 37/32183 118/723 I
8,766,541 B1 * 7/2014 Hoff ..... H01J 23/06 315/111.21
2001/0011930 A1 * 8/2001 Kintis ..... H03K 5/12 333/20
2004/0183470 A1 * 9/2004 Geissler ..... H01J 1/135 315/248
2005/0035889 A1 * 2/2005 Faris ..... H03M 1/32 341/133
2005/0238306 A1 * 10/2005 Elisabeth Breuls ..... C03B 37/02718 385/123
2006/0029120 A1 * 2/2006 Mooradian ..... H01S 5/1021 372/102
2007/0183728 A1 * 8/2007 Breuls ..... C03B 37/02718 385/123
2008/0122531 A1 * 5/2008 Kirshner ..... H01J 25/34 330/44
2009/0309509 A1 * 12/2009 Geissler ..... H05B 41/295 315/276
2010/0026160 A1 * 2/2010 Terui ..... B82Y 10/00 313/308

OTHER PUBLICATIONS

Chadwick et al "A novel Solid state HPM source based on Gyromagnetic NLTL and SOS based pulse generator" IEEE publications 2011.*
French et al "Nonlinear Transmission line based electron beam driver" Revi of Sci Instrum 83 123302 (2012).*
Gaudet et al "Non Linear Transmission Lines for high power microwave applications—Survey" IEEE Proceedings 2008.*
Paul W Smith"High power pulsed RF generation from Nonlinear Lumped Element Transmission Lines NLETL" May 2011.*

* cited by examiner

NONLINEAR TRANSMISSION LINE BASED ELECTRON BEAM DENSITY MODULATOR

CROSS-REFERENCE TO RELATED APPLICATION

This application is a divisional application of U.S. patent application Ser. No. 13/245,250 filed on Sep. 26, 2011, and claims the benefit of the foregoing filing date.

STATEMENT OF GOVERNMENT INTEREST

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF THE INVENTION

The present invention is generally related to a method for modulating the density of an electron beam as it is released from a cathode, and in particular relates to coupling a cathode to a nonlinear transmission line to modulate an electron beam emitted by the cathode.

In many electron beam-related applications, it is highly desirable or necessary to be able to modulate the density of an electron beam as it is released from the cathode. In grid-controlled microwave tubes, such as inductive output tubes and planar triodes, this is done by applying a dc voltage between the cathode and anode of a vacuum diode and then using a control grid with a time varying voltage bias a very short distance (as little as ~0.1 mm) from the cathode. The control grid bias determines the amount of current that is released from the cathode. The highest frequency of these tubes is limited by the electron transit time in the cathode to grid region. The requirement for a cathode control grid increases expense and complexity as well as introducing additional failure methods (such as inadvertent shorting of the cathode to the grid due to contaminates or warping of the grid or cathode).

In many accelerators, a modulated electron beam is created using laser light pulses to eject electrons from a photocathode. The laser system and associated focusing optics add considerable cost and complexity to accelerator cathodes.

This invention provides a novel and efficient way to modulate the current density of an electron beam emitted from a cathode without the need for complicated control grids or laser-based photoemission techniques used in current microwave tubes and accelerators.

SUMMARY

The present invention provides a novel and efficient way to modulate the current density of an electron beam emitted from a cathode without the need for complicated control grids or laser-based photoemission techniques currently in use. The current density is modulated by coupling a vacuum diode to a nonlinear transmission line (NLTL). This connection may be made from the NLTL to the cathode or from the NLTL to the anode of the electron beam diode.

A dispersive NLTL can be used to convert a pulsed voltage input into a modulated output at microwave frequencies. A non-dispersive NLTL, or shockline, can be coupled to the cathode to produce an electron beam with a very sharp density gradient on the leading edge of the beam.

Because the NLTL can be incorporated into the power system, this invention enables one to directly modulate the input voltage pulse to the cathode in a controllable and repeatable manner at high frequencies (>500 MHz) and provides an apparatus that is simpler, less expensive, and more robust than current devices.

DESCRIPTION OF THE PREFERRED EMBODIMENT

Figure 1:
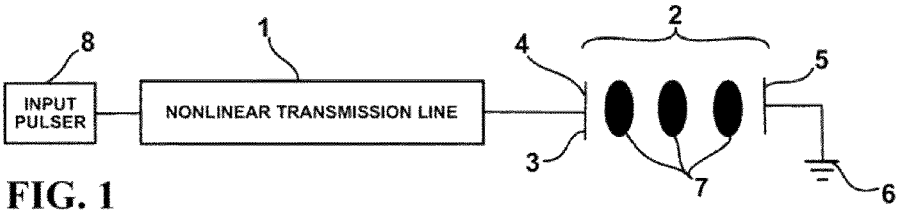
FIG. 1 is a conceptual drawing which describes the coupling of a nonlinear transmission line to the cathode or anode of an electron beam diode in order to allow for the generation of a modulated electron beam.

FIG. 1 is a conceptual drawing of one embodiment of the present invention in which a nonlinear transmission line 1 (NLTL) is coupled to an electron beam diode of an electron beam device 2. A first terminal 3 of the electron beam diode is connected to the output of the nonlinear transmission line (NLTL) 1 via a connection 4 which can represent either a direct connection between terminal 3 and the NLTL or a connection via a length of transmission line. In this drawing, a second terminal 5 is connected to ground 6. In the case where the modulated potential applied to the first terminal 3 is negative with respect to the grounded terminal 5, the first terminal 3 will be the cathode and the modulated electron beam 7 will travel from the cathode toward the grounded terminal or anode 5. In the case where the modulated potential applied to the first terminal 3 is positive with respect to the grounded terminal 5, the grounded terminal will be the cathode and the modulated electron beam 7 will travel from the cathode 5 toward the anode 3. The input pulser 8 provides pulsed input power to the NLTL. The NLTL may be coupled to the anode or cathode of an electron beam diode by either a direct electrical connection or via a capacitive or inductive coupling connection. The specific nature of the connection will change depending on the type of NLTL or cathode/anode used as would be apparent to one skilled in the art.

The nonlinearity of the electromagnetic response of the nonlinear transmission line may be due nonlinear dielectric materials, nonlinear magnetic materials, or a combination of nonlinear dielectric and nonlinear magnetic materials. Additionally, this nonlinear transmission line may be dispersive or a shock line.

Figure 2A:
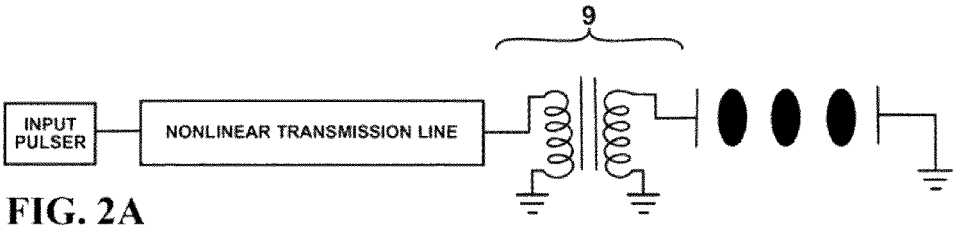
FIGS. 2A, 2B and 2C comprise conceptual drawings which respectively describe the coupling of a nonlinear transmission line to the cathode or anode of an electron beam diode via an impedance transformer, a capacitive connection, and an inductive connection, to provide for the generation of a modulated electron beam.
Figure 2B:
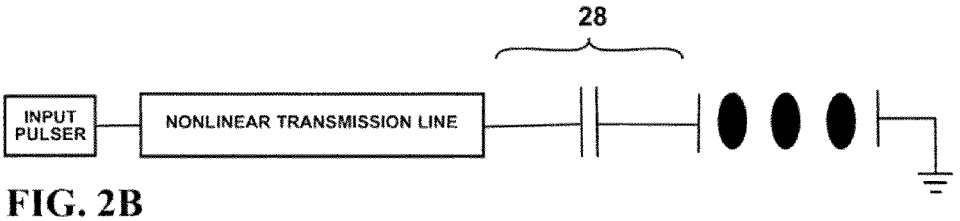
Figure 2C:
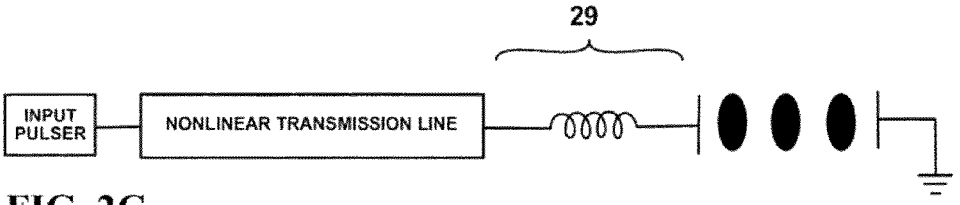

FIG. 2A depicts a NLTL coupled to an electron beam diode 2 via an impedance transformer 9. This type of configuration would prove to be advantageous in cases where the electron beam diode impedance differs substantially from the output impedance of the NLTL. Alternatively, the impedance transformer 9 of FIG. 2A may simply consist of the capacitive coupling 28 shown in FIG. 2B or the inductive coupling 29 shown in FIG. 2C.

The electron beam diodes depicted in FIG. 1 and FIG. 2 are greatly simplified to allow for ease of understanding of the present invention. Additionally, although the grounded terminal 5 of FIG. 1 and FIG. 2 is shown to be tied to ground for the sake of simplicity, both the cathode and anode could, in principle, be separately biased with respect to ground such that the effective voltage across the diode would be the difference of the dc biases on the cathode and anode plus the modulated voltage output of the NLTL.

Figure 4:
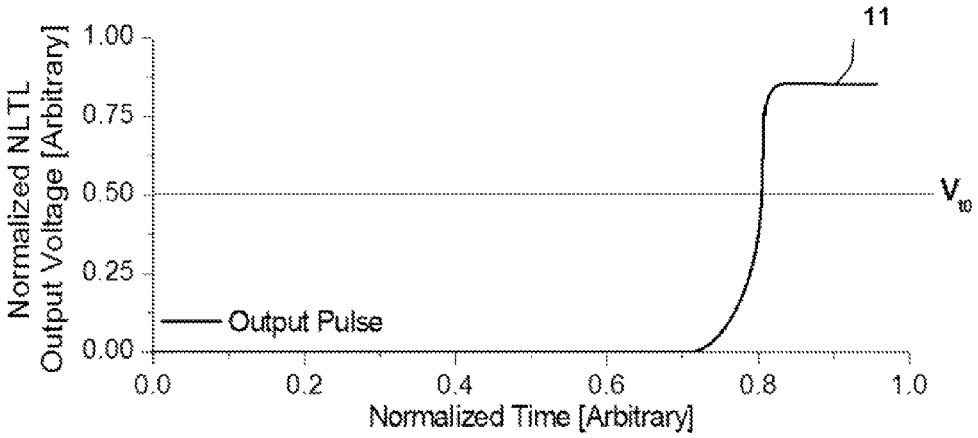
FIG. 4 is a plot of the output signal for a hypothetical non-dispersive nonlinear transmission line "shock line." The long rise time input pulse of FIG. 3 is converted to a very short rise time voltage pulse by the shock line.
Figure 3:
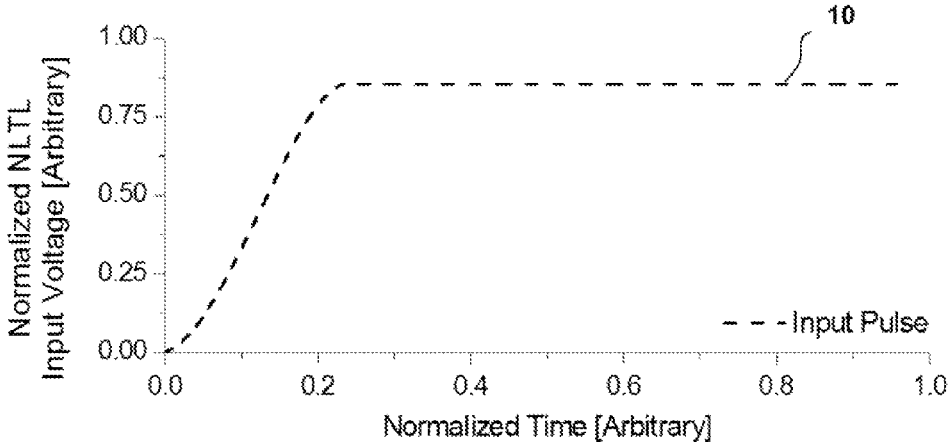
FIG. 3 is a plot of the input signal for a hypothetical non-dispersive nonlinear transmission line "shock line."

FIG. 3 is a plot of an input signal of a simulated nonlinear transmission line shock line. The long rise time input voltage pulse 10 is sharpened to a much shorter rise time voltage pulse 11 during its transit down the shock line as seen in FIG. 4. The voltage scales and the time scales in both plots are normalized. The voltage threshold $Vt_0$ is chosen as an example emission threshold for a hypothetical cathode.

Figure 5:
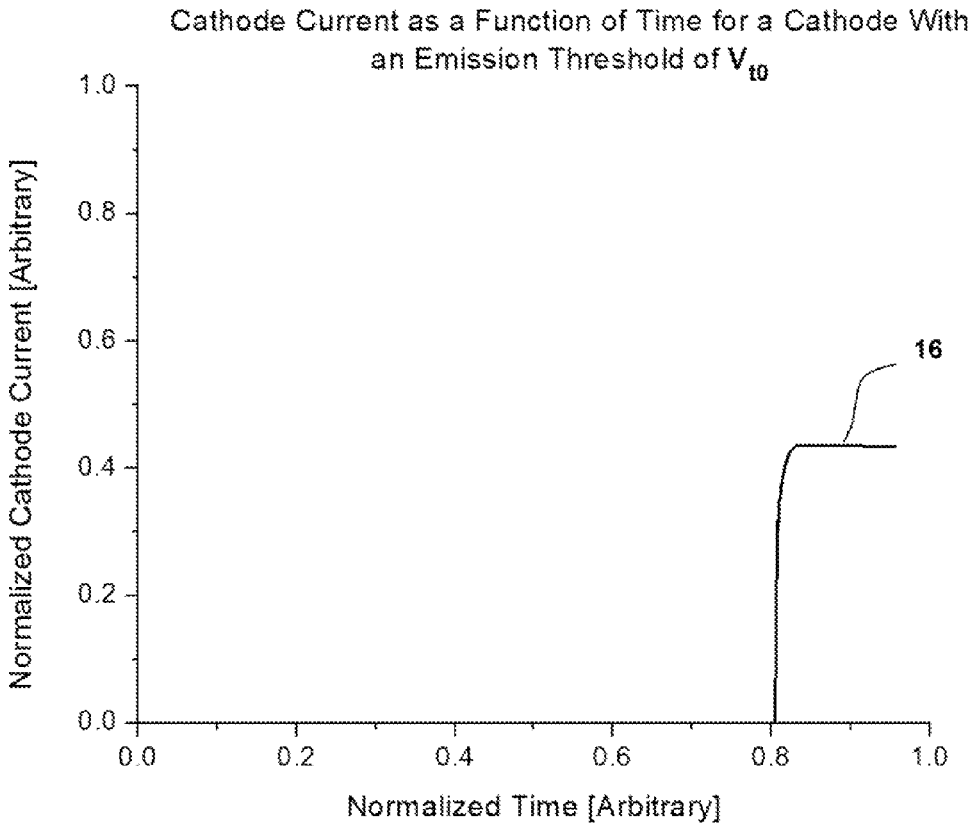
FIG. 5 is plot of the predicted cathode current as a function of time for a cathode with an emission threshold of $Vt_0$ in an electron beam diode across which the voltage waveform of FIG. 4 is applied.

FIG. 5 is a plot of the predicted cathode current 16 as a function of time for a cathode with an emission threshold of $Vt_0$ in a electron beam diode, across which the voltage waveform 11 of FIG. 4 is applied. For the purposes of this illustration, it was assumed that the cathode is an idealized space-charge-limited emission cathode in which the electron emission scales as a function of voltage to the 3/2 power, $V^{3/2}$. In actual practice, the emission properties and type of each individual cathode must be taken into account when calculating predicted current yields. The cathode current scale in this plot is normalized for simplicity. The time scale is the same as that used in FIG. 4.

Figure 6:
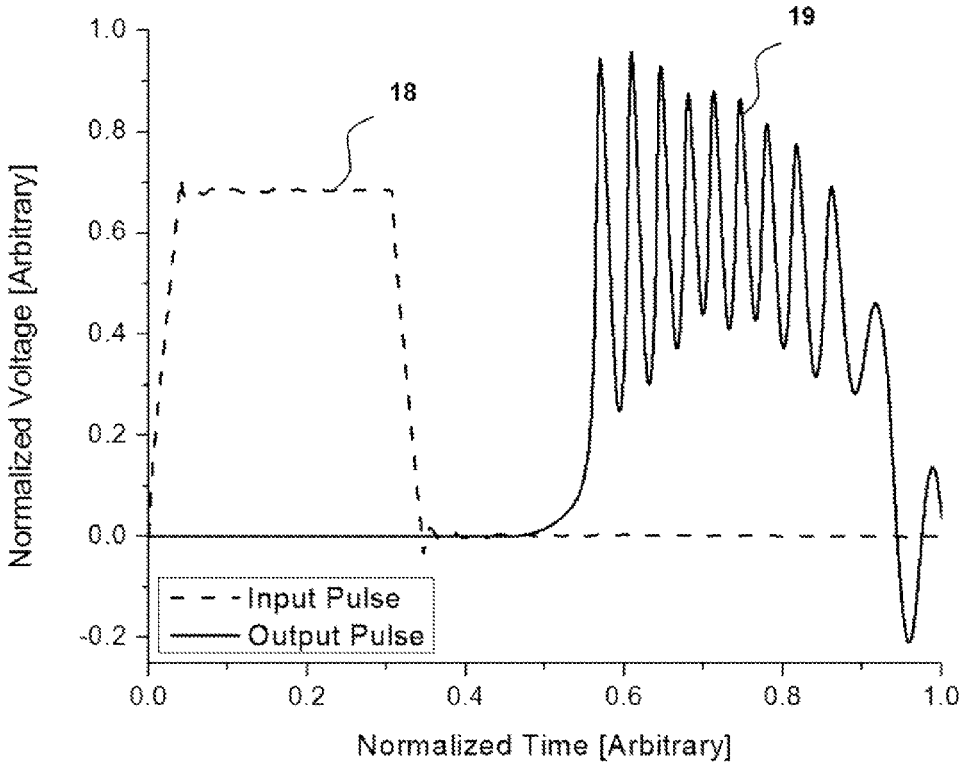
FIG. 6 is a plot of the input and output voltage signals for a dispersive nonlinear transmission line. The input signal is converted to a modulated output signal by the nonlinear transmission line.

FIG. 6 is a plot of the input and output voltage signals from a simulated dispersive nonlinear transmission line. The NLTL converts the video pulse-like input signal 18 into an RF output signal or output signal consisting of a series of electromagnetic soliton-like pulses 19. A normalized voltage scale and time scale were used in this plot. The output signal 19 of the NLTL data in FIG. 6 is again shown in FIG. 7 as it is applied across an electron beam diode. The voltage thresholds $Vt_1$ and $Vt_2$ are also shown. These voltage thresholds represent electron emission voltage thresholds for two different hypothetical cathodes. The voltage scale and time scale are the same as those used in FIG. 6. As will be evident from the next two figures, the choice of emission threshold allows a degree of control of the modulation amplitude imposed on the electron beam.

Figure 7:
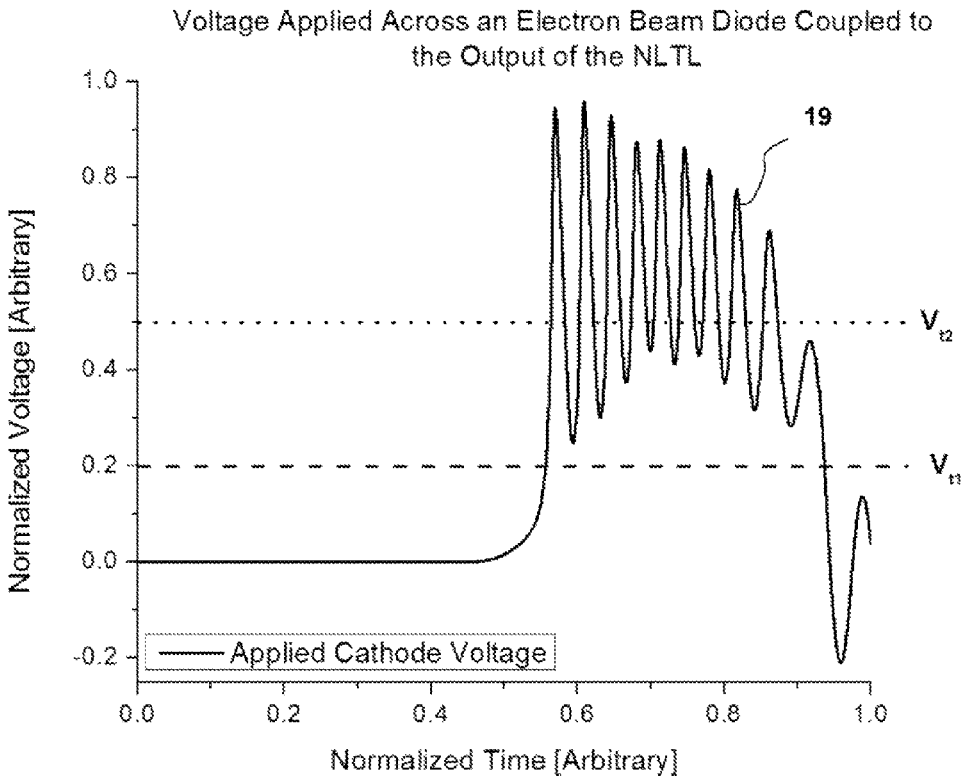
FIG. 7 is a plot of the output voltage signal of FIG. 6 applied as applied across an electron beam diode with voltage thresholds $Vt_1$ and $Vt_2$ shown.
Figure 8:
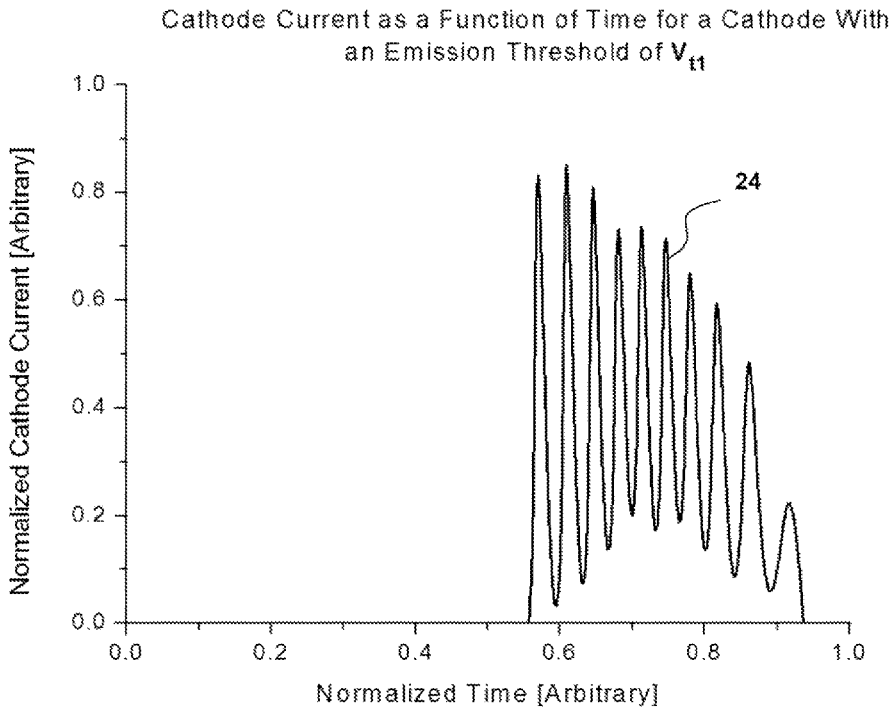
FIG. 8 is a plot of the expected current output of a cathode which is driven by the output of the nonlinear transmission line associated with the traces depicted in FIG. 6 and which has the emission threshold voltage $Vt_1$.

FIG. 8 is a plot of the predicted cathode current 24 as a function of time for a cathode with emission threshold $Vt_1$ in an electron beam diode, across which the voltage waveform 19 of FIG. 7 is applied. For the purposes of this illustration, it was assumed that the cathode is an idealized space-charge-limited emission cathode in which the electron emission scales as a function of voltage to the 3/2 power, $V^{3/2}$. As is evident from the plot, the cathode would emit an electron beam which is modulated at the frequency of the output of the NLTL. The cathode current scale is normalized for simplicity. The time scale is the same as that used in FIG. 6.

Figure 9:
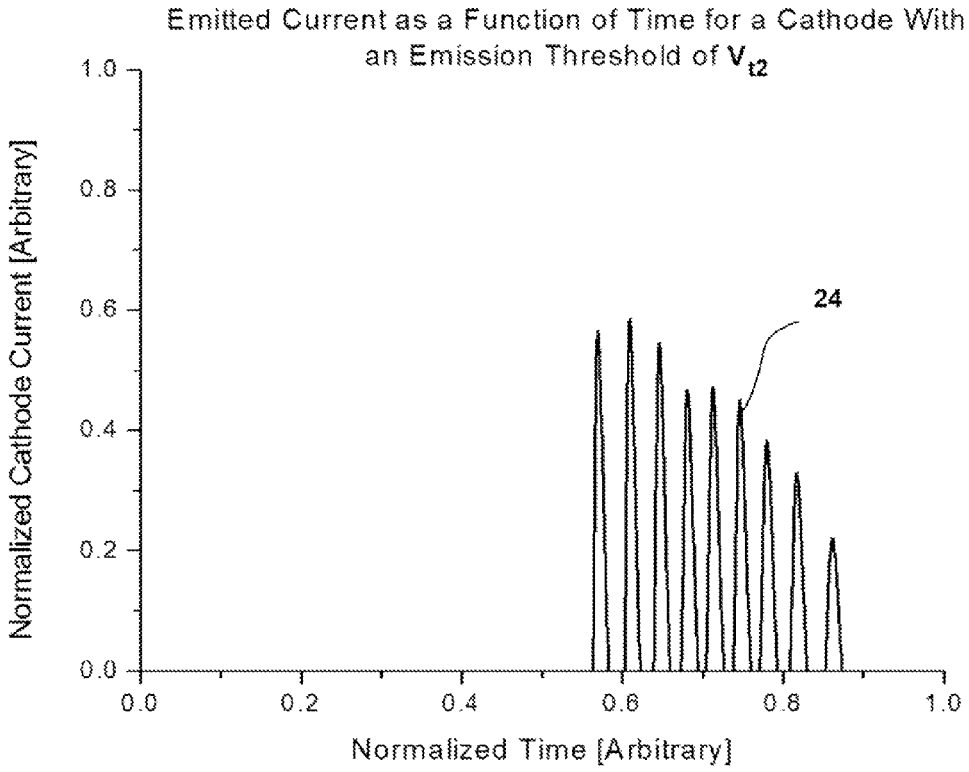
FIG. 9 is a plot of the expected current output of a cathode which is driven by the output of the nonlinear transmission line associated with the traces depicted in FIG. 6 and which has the emission threshold voltage $Vt_2$.

FIG. 9 is a plot of the predicted cathode current 24 as a function of time for a cathode with emission threshold $Vt_2$ in an electron beam diode, across which the voltage waveform 19 of FIG. 7 is applied. For the purposes of this illustration, it was assumed that the cathode is an idealized space-charge-limited emission cathode in which the electron emission scales as a function of voltage to the 3/2 power. In this case, the choice of electron emission of the cathode results in stronger relative modulation of the electron beam in that discrete electron bunches being emitted from the cathode at the frequency of the output of the NLTL. The cathode current scale is normalized for simplicity. The time scale is the same as that used in FIG. 6.

The invention claimed is:

1. An apparatus for modifying the density of an electron beam being emitted from a cathode comprising:

a nonlinear transmission line having an output;

an electrical connection for connecting the nonlinear transmission line to a source of pulsed output power;

an electron beam diode having a cathode; and an electrical connection for connecting the output of the nonlinear transmission line to the cathode of the electron beam diode.

2. The apparatus as defined by claim 1, wherein the electrical connection is a direct electrical connection.

3. The apparatus as defined by claim 1, wherein the electrical connection is a capacitive or inductive coupling.

4. The apparatus as defined by claim 1, wherein the electrical connection is a direct electrical connection.

5. The apparatus as defined by claim 1, wherein the electrical connection is a capacitive or inductive coupling.

6. An apparatus for modifying the density of an electron beam as the beam is being emitted from a cathode, comprising:

a nonlinear transmission line having an impedance and an output;

an electrical connection for connecting the nonlinear transmission line to a source of pulsed input power;

the output of the nonlinear transmission line for being connected to an impedance transformer having a transformer output;

an electron beam diode having a cathode and having an electron beam diode impedance; and the transformer output for being connected to the cathode of the electron beam diode, for matching the electron beam diode impedance with the impedance of the nonlinear transmission line.

7. The apparatus as defined by claim 6, wherein the electrical connection between the nonlinear transmission line and the source of pulsed input power is a direct electrical connection.

8. The apparatus as defined by claim 6, wherein the electrical connection between the nonlinear transmission line and the source of pulsed input power is a capacitive or inductive coupling.

9. The apparatus as defined by claim 6, wherein the electrical connection between the dispersive nonlinear transmission line and the source of pulsed input power is a direct electrical connection.

10. The apparatus as defined by claim 6, wherein the electrical connection between the source of pulsed input power and the dispersive nonlinear transmission line and the source of pulsed input power is a capacitive or inductive coupling.

* * * * *